United States Patent [19]

Miller

[11] 4,375,202

[45] Mar. 1, 1983

[54] APPARATUS FOR COATING PAPER WEBS

[76] Inventor: Balthasar C. Miller, Eugen-Bolz-Str. 12, Reutlingen, Fed. Rep. of Germany, FRG-7410

[21] Appl. No.: 260,747

[22] Filed: May 5, 1981

[30] Foreign Application Priority Data

May 6, 1980 [DE] Fed. Rep. of Germany ..... 3017274

[51] Int. Cl.[3] ..... B05C 11/04

[52] U.S. Cl. ..... 118/117; 118/122; 118/126; 118/119

[58] Field of Search ..... 118/122, 123, 126, 121, 118/119, 110, 117, 115; 15/256.51

[56] References Cited

U.S. PATENT DOCUMENTS 3,113,890 12/1963 Johnson et al. ..... 178/126

FOREIGN PATENT DOCUMENTS 2825907 12/1979 Fed. Rep. of Germany ..... 118/126

2845036 4/1980 Fed. Rep. of Germany ..... 118/122

*Primary Examiner*—John P. McIntosh

*Attorney, Agent, or Firm*—Wigman & Cohen

[57] ABSTRACT

Apparatus for coating paper webs having a doctor blade held in a clamping device which is mounted in a moveable holder. The clamping device is mounted to be pivotable about an axis parallel to the pivot axis of the holder and at a distance from the end of the doctor blade which is greater than the distance from the end of the clamping device.

5 Claims, 3 Drawing Figures

1
2
3
4
5
6
7
8
9
10
11
12
12
13
14
15
16
17
a
b
c
d

Web
1

3
20
21
2
4
9
13'
12
15
12
7
16
14
10
11
8
5
6

APPARATUS FOR COATING PAPER WEBS

BACKGROUND OF THE INVENTION

The invention relates to an apparatus for coating paper webs with at least one doctor blade which is clamped at one end thereof in a clamping device mounted in a holder so as to be movable and capable of being set in a selectable position. The holder, in turn, is pivotably arranged in a frame and includes a support body which supports the doctor blade in its operating position on the side thereof opposite the paper web. When in this operating position, the doctor blade exhibits two opposite curves or bends between its free end and the end clamped in the clamping device.

SUMMARY AND OBJECTS OF THE INVENTION

In known devices of this type it is difficult to hold the doctor, or with two sided coating the doctors, continually in the optimal position. It is therefore the object of the invention to create a coating device of the above-described type which makes it possible to continuously hold both the geometric relationships in the vicinity of the tip of the doctor or doctors as well as the set pressure without problem.

This object is achieved by an apparatus of the above-described type, in which the clamping device in the holder is mounted so as to be pivotable about an axis lying parallel to the pivot axis of the holder and at a distance from the end of the doctor blade located in the clamping device which distance is greater than the distance from the end of the clamping device at which the doctor extends therefrom and in which $a+b \leqq c$ and $d<500$, where a is the distance of the free doctor blade end from the point where it contacts the support body, b is the distance of this point from the point where the doctor blade leaves the clamping device, c is the distance of the point where the doctor blade leaves the clamping device from the pivot axis of the clamping device and d is the distance of the pivot axis from the plane defined by the contact point of the support body and the pivot axis of a support for the holder.

With this embodiment of the coating device the location of the point where the tip of the doctor blade contacts the web does not change or at least moves only a negligible amount during a change in the contact pressure. The geometric relationships for the wedge-shaped space between the doctor tip and the web therefore does not change, nor are the pass-through relationships changed by a change in the contact pressure. In embodiments for a two-sided coating, i.e., double doctor blade composite machines, this means that when, as is common, the common pivot axis of the two holders lies at a certain distance from the doctor blade tips, this distance does not change or does not change significantly when the contact pressure is changed, so that even under these circumstances the geometrical relationships in the two wedge-shaped spaces between the doctors and the web experience no change. Furthermore, the embodiment of the coating device according to the invention provides a linear curve in the relationship between the support force and the heaviness of the coating, which is influenced by the contact pressure. This allows a precisely dosed and direct adjustment of the coating weight with simple means, which is also very important, since the viscosity of the coating mass continually changes, making a rapid and precise reaction to changes in viscosity by changing the contact pressure very important.

The constancy of the position of the doctor blade tip or tips during changes in the contact pressure allows a simple control of this pressure by means of a process computer in such a manner that the application of the coating mass remains independent of the speed. If the contact pressure were not changed in dependence on speed then with increasing speed the doctor blade would be lifted further and further from the web as a result of the increasing hydraulic pressure in the nip between the doctor blade and the paper web. In addition, the process computer can see to it that the set angle of the doctor blade or blades is changed in dependence on the roughness of the paper web. The rougher the paper web, the greater the set angle must be in order to shorten the effective zone of the doctor blade. The roughness can be continuously measured with a smoothness measuring device.

In a preferred embodiment the support body which contacts the doctor blade between its free end and its clamped end includes a knife-like edge as the contact surface for the doctor blade, because this results in the most favorable bending relationships for the doctor blade.

The doctor blade or blades can also be formed as roll doctors.

The invention is described in greater detail below with the aid of two exemplary embodiments illustrated in the drawings.

DETAILED DESCRIPTION OF THE PREFERRED EMBODIMENTS

Figure 1:
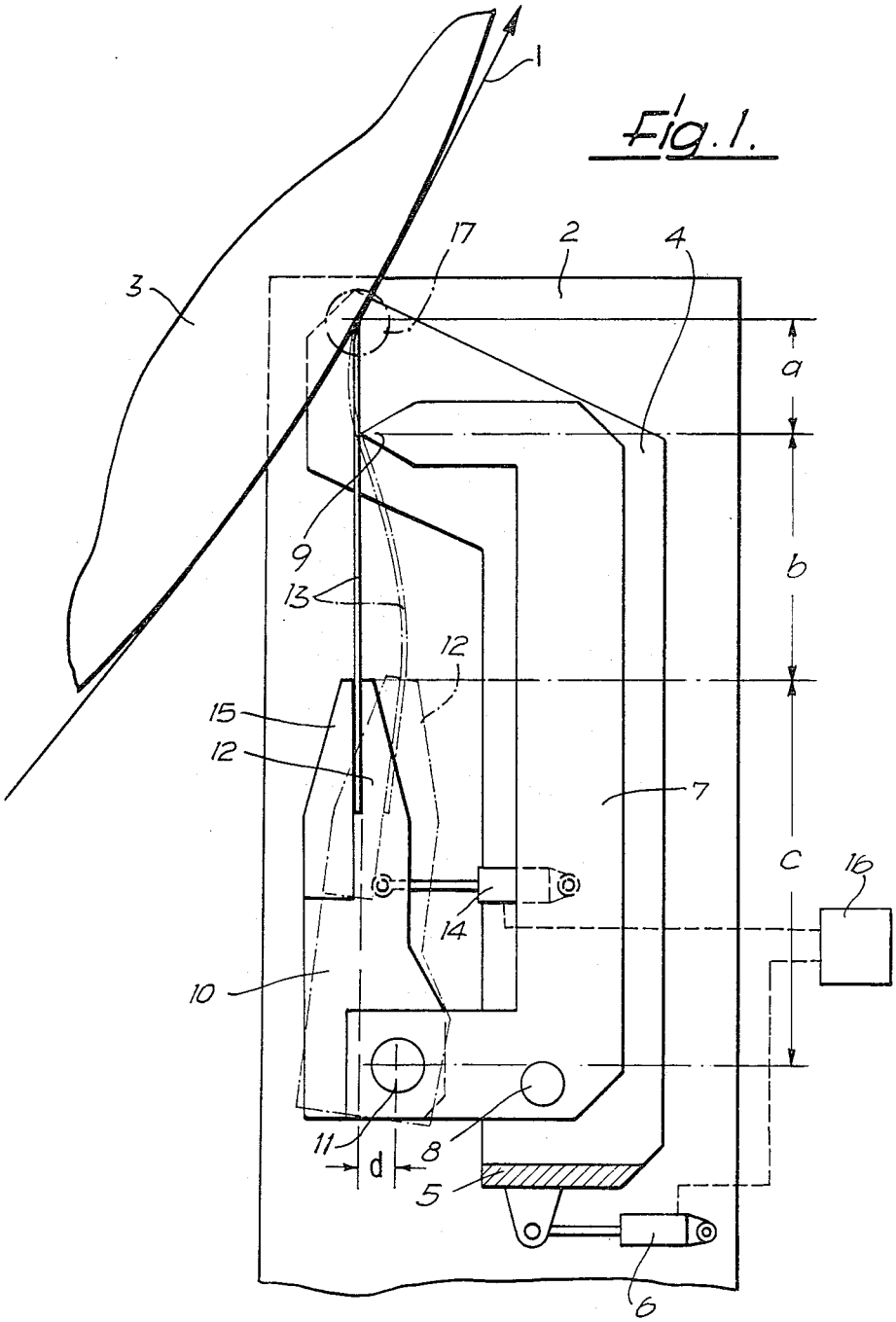
FIG. 1 is a schematic, partial view of an exemplary embodiment for a one-sided coating.

An apparatus for one-sided application of a coating material on a paper web 1 includes a frame, of which only one of the two side plates 2 is schematically illustrated in FIG. 1. The distance of these two side plates 2 from each other is greater than the axial length of a roller 3, over which the paper web 1 runs during the coating process. The roller 3 can therefore pass between the two side plates 2, as may be seen in FIG. 1. A side element 4 of a support is mounted in each of the side plates 2 by means of a mounting pin 17, which is enlarged in the drawing for better illustration. The pivot axis defined by the two mounting pins for the side elements 4 lies parallel to the axis of rotation of the roller 3 and in a plane lying tangential to the roller surface. The distance of the two mirror-image side elements 4 from each other is therefore also greater than the axial length of the roller 3. The side elements 4, which are mounted in the vicinity of their upper ends by means of the mounting pins are rigidly connected with each other by means of a yoke element 5, so that they are held in the same angular position relative to each other. The adjustment and setting of the support in a certain angular position is provided by an adjustment device 6, which in the exemplary embodiment engages the yoke element 5.

A holder 7 is pivotably mounted in the support, namely in the region of its lower end. The pivot axis 8, which lies parallel to the mounting pins 17, is arranged in the vicinity of the lower shank of the C-shaped holder 7 and serves to pivot this holder between the operational position shown in FIG. 1 and a position reached by a clockwise pivot movement as viewed according to FIG. 1, which position the holder assumes, for example, when the coating device is not in operation. The pivot device which effects this pivoting movement of the holder 7 and sets the holder in its operational position is not illustrated, since it is a conventional pivot drive.

The upper shank of the holder 7, which lies lower than the mounting pins of the side plates 2, is directed toward the roller 3 and at its free end forms a knife-edge 9, which runs parallel to the axis defined by the mounting pins 17, but lies beneath this axis by a distance a. The lower shank of the holder 7 extends from the yoke in the same direction as the upper shank, but is formed by two arms, between which a clamping device 10 is mounted by means of pivot pins 11. The axis defined by the pivot pins 11 lies parallel to the knife-edge 9 and the axis defined by the mounting pins. The distance d of this axis from the plane defined by the mounting pins 17 and the knife-edge 9 is less than 500 mm.

As shown in FIG. 1, the clamping device 10 includes a clamping jaw 12 supported by the pivot pins 11. This clamping jaw 12 extends toward the knife-edge 9 and forms on its upper portion on the side facing the roller 3 an even contact surface for a doctor blade 13. In the positions of the side elements 4 of the support and the clamping device 10 shown in FIG. 1 the contact surface of the clamping jaw 12 lies in the plane defined by the longitudinal axis of the mounting pins and the knife-edge 9. It can, however, also be brought into other pivot positions by means of a pivot drive 14, which is hinged at one side to the clamping jaw 12 and at the other side to the yoke of the support. In addition, the pivot drive 14 holds the clamping jaw 12 in the selected position. A second clamping jaw 15 can be tensed against the contact surface of the clamping jaw 12, so that the lower end of the doctor 13 can be securely held in the clamping device. The distance between the knife-edge 9 and the frontal side of the clamping device 10 facing it is designated with b, and the distance between the frontal side of the clamping device 10, which is the point at which the doctor blade projects from the clamping device, and the pivot axis of pin 11 is designated with c. The relationship of these distances to each other is selected in such a manner that $a+b \leqq c$. By this means the position of the free end of the doctor blade 13 to be pressed against the paper web 1 does not change or at best changes by only a negligible amount when the clamping device 10 is pivoted clockwise out of the pivot position illustrated in FIG. 1 and the doctor blade is thereby bent into the shape of an S to adjust the set pressure of the doctor blade 13, i.e., to adjust the force with which the free end of the doctor blade is pressed against the paper web 1. In so doing, the point where the shape of the bending changes lies in the zone adjacent the knife-edge 9 as shown in FIG. 1.

Both the adjustment device 6, by means of which the set angle of the doctor blade 13 is adjusted, and the pivot drive 14 are controlled by a process computer 16, as indicated symbolically in FIG. 1.

Figure 3:
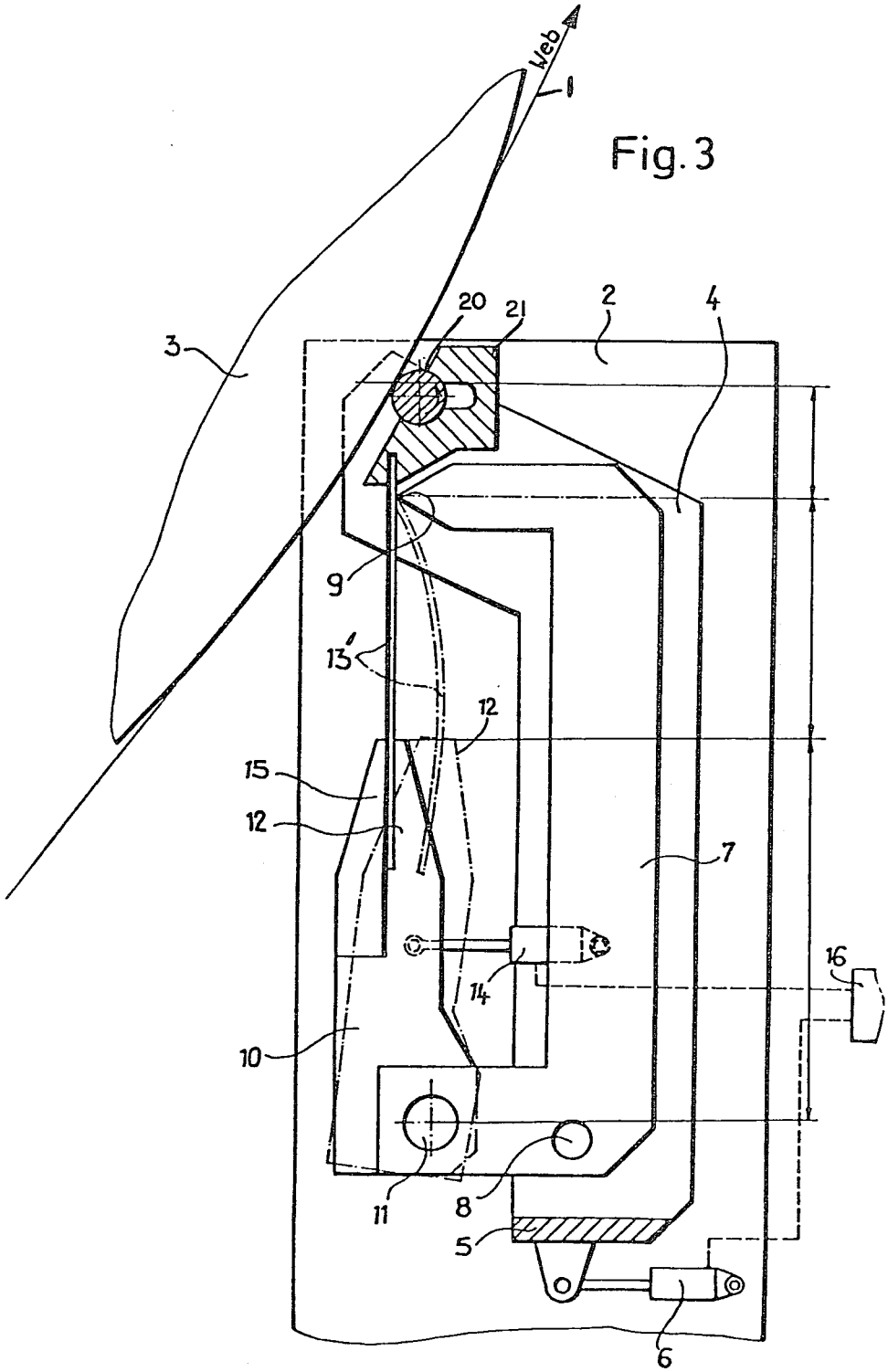
FIG. 3 is a schematic, partial view of an alternate embodiment for a one-sided coating.

FIG. 3 shows a one-sided coating apparatus similar to the apparatus of FIG. 1, except that a roller doctor 20 is utilized to contact the paper web 1 in place of the free end of the doctor blade 13. The rotatable roller 20 is supported by a holder 21 fastened at the free end of the doctor blade 13'. The doctor blade 13' differs from the doctor blade 13 of FIG. 1 only by its shorter length. Since the doctor blade 13' is shorter than the blade 13, the roller doctor 20 is pressed against the web 1 at the same line as the doctor blade 13 of FIG. 1.

Figure 2:
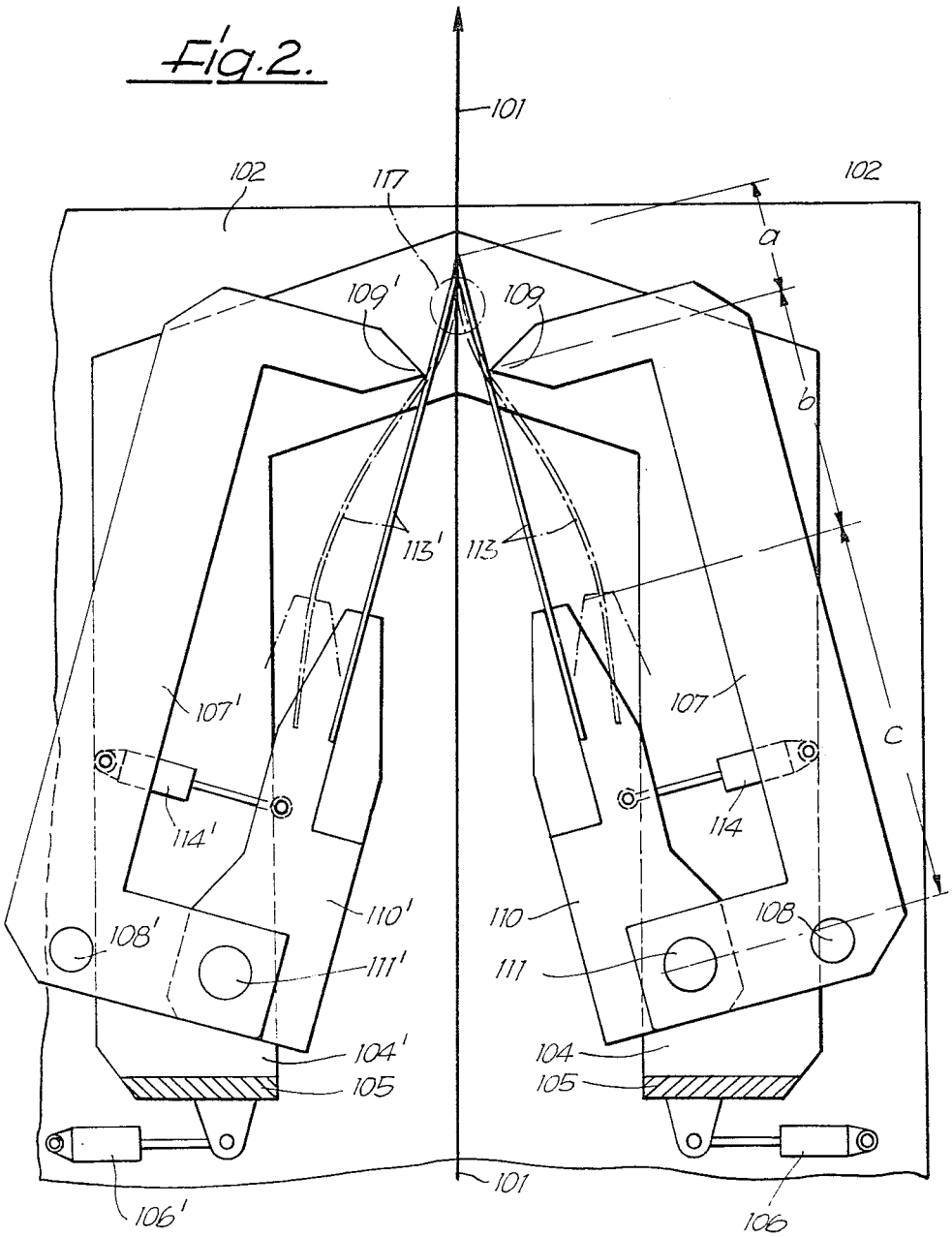
FIG. 2 is a schematic, partial view of an exemplary embodiment for a two-sided coating

The exemplary embodiment illustrated in FIG. 2 for a double-sided coating basically consists of two devices for a one-sided coating, as a comparison of FIGS. 1 and 2 shows. The free ends of the two doctor blades 113 and 113' can be pressed against the respective sides of the paper web 101 which passes between them. Their other ends are held in clamping devices 110, 110', both of which are formed like the clamping device 10 of the first exemplary embodiment. These clamping devices 110, 110' are pivotably mounted at their lower ends between two arms by means of pivot pins 111, 111', which arms form the lower shank of a C-shaped holder 107, 107', both of which are formed and arranged as mirror-images of each other. The respective upper shanks of the holder 107, 107', are directed towards each other and form at the same height respective knife-edges 109, 109', which contact the doctor blades 113, 113', at a distance c from their free ends. By means of respective pivot drives 114, 114', the clamping devices 110, 110' can be pivoted relative to the holder in order to press the doctor blades with the desired set pressure against the paper web while forming an S-shaped bending of the doctor blades.

These two holders 107 and 107' are each pivotably mounted in a support in the vicinity of their lower shanks, the side elements 104, 104' of which are visible in FIG. 2. The pivot axes 108 and 108' of the two clamping devices lie parallel to each other and to the axes defined by the pivot pins 111 and 111', which, in turn, lie parallel to the paper web 101.

The side elements 104 and 104', the upper end sections of which overlap, are pivotably mounted at these end sections in the side plates 102 of a frame (otherwise not shown) by means of two mounting pins 117. The contrast to the exemplary embodiment according to FIG. 1, the pivot axis defined by the mounting pins lies somewhat lower than the free ends of the two doctor blades 113 and 113', which point toward each other. This pivot axis lies in the wedge-shaped space formed by the doctor blades, as shown in FIG. 2. The side elements 104 of the two supports are rigidly connected with each other by a yoke element 105. Adjusting devices 106, 106' engage the yoke elements 105 and are connected at their other ends with the side plates 102. These adjusting devices not only pivot the support, but can also be set in any selected pivot position. As in the exemplary embodiment according to FIG. 1, the adjustment devices 106 and 106' can adjust the set angle of the doctor blades 113, 113' and the set pressure can be adjusted by means of the pivot drive 114, 114'. This embodiment also corresponds with the exemplary embodiment according to FIG. 1 with regard to the distances a, b, c, and d, i.e., the equations $a+b \leqq c$ and $d<500$ mm. The distance a is measured between the free ends of the two doctor blades 113 and 113' and the knife-edges 109, 109' supporting them. The distance b is measured between the knife-edge 109, 109' and the side of the clamping devices 110, 110' facing them, and the distance c is measured between this side and the pivot axis of the clamping device. d is used to designate the distance of the axes defined by the pivot pins 111 and 111' from the planes defined by the mounting pins 117 and the knife-edges 109, 109'.

As in the exemplary embodiment according to FIG. 1 a pivoting movement of the clamping devices 110 and 110' causes a change in the adjustment pressure of the doctor blades 113, 113', whereby, however, the position of the free end of the doctor blade does not change or at least changes only by a negligible amount. The set angle of the doctor blades is adjusted by means of the adjusting devices 106, 106'. A process computer which controls both adjusting devices as well as the pivot drives 114 and 114' is not shown in FIG. 2.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Apparatus for coating paper, comprising:

a frame mounted in a support means so as to be pivotable about a first pivot axis and capable of being set in selectable positions;

a holder mounted in said frame so as to be pivotable about a second pivot axis, which second pivot axis lies parallel to the first pivot axis;

a clamping device for clamping at least one doctor blade in the vicinity of one of its ends, which clamping device is mounted in said holder so as to be pivotable about a third pivot axis and is capable of being set in selected positions, said third pivot axis lying parallel to the first pivot axis;

said holder includes a support body which supports the doctor blade in its operating position, where it has two opposite bends, on its side opposite the paper web at a point between its free end and its end which is clamped in the clamping device; and for the distance (a) of the free end of the doctor blade from the line of contact with the support body, for the distance (b) of this line from the point where the doctor blade projects from the clamping device, for the distance (c) of this projection point from the third pivot axis and for the distance (d) of the third pivot axis from the plane defined by said line of contact and said first pivot axis, the conditions $a+b \leqq c$ and $d<500$ mm hold true.

2. Apparatus according to claim 1, wherein the support body includes a knife-edge as a contact surface for the doctor blade.

3. Apparatus according to claim 1 or 2, wherein the doctor is formed as a roller doctor.

4. Apparatus according to claim 1, wherein the clamping device includes a computer-controlled pivot drive.

5. Apparatus according to claim 1 or 4, wherein for a two-sided coating the two doctor blades, the clamping devices and the holders are formed and arranged as mirror-images of each other.

* * * * *